United States Patent [19]

Hill

[11] 4,057,967

[45] Nov. 15, 1977

[54] REINFORCED ICE MATRIX

[75] Inventor: William L. Hill, Richardson, Tex.

[73] Assignee: Suntech, Inc., St. Davids, Pa.

[21] Appl. No.: 686,625

[22] Filed: May 14, 1976

[51] Int. Cl.[2] ..... F25D 1/00

[52] U.S. Cl. ..... 61/1 R; 61/5; 61/36 A; 62/235

[58] Field of Search ..... 61/36 A, .5, 1 R; 62/235, 259, 260, 238; 165/45

[56] References Cited

U.S. PATENT DOCUMENTS

| | | | |
|---|---|---|---|
| 1,810,926 | 6/1931 | Palson | 62/235 |
| 2,270,745 | 1/1942 | Todd | 62/235 |
| 2,558,580 | 6/1951 | Pomykala | 61/.5 X |
| 2,961,840 | 11/1960 | Goldtrap | 61/.5 X |
| 2,997,770 | 8/1961 | Beltz | 62/235 X |
| 3,205,665 | 9/1965 | Van Horn | 61/.5 |
| 3,289,425 | 12/1966 | Shrier | 61/.5 X |
| 3,914,915 | 10/1975 | Van Schyndel | 52/664 |
| 3,950,911 | 4/1976 | Fox | 52/664 |

FOREIGN PATENT DOCUMENTS

| | | | |
|---|---|---|---|
| 524,995 | 1920 | France | 52/404 |
| 50,843 | 1910 | Switzerland | 62/235 |

*Primary Examiner*—Dennis L. Taylor

*Attorney, Agent, or Firm*—J. Edward Hess; Donald R. Johnson

[57] ABSTRACT

A system for preventing a surface ice sheet from cracking and failing under a load based upon the principle of counteracting lateral tension forces in the lower portion of the ice sheet. A matrix of cables is placed on the bottom surface of the ice, and the ends of the cables are anchored on the top surface of the ice. As new ice forms, the matrix becomes embedded in the ice sheet and reinforces it in tension.

12 Claims, 3 Drawing Figures

REINFORCED ICE MATRIX

BACKGROUND OF THE INVENTION

The present invention relates to a method of increasing the load supporting capacity of an ice sheet.

Conventionally an ice sheet must attain a specific thickness before it can support a load or loads of given weight and weight distribution. The growth rate and maximum thickness of naturally occurring ice sheets vary from year to year. This variance is influenced by several factors, among which are the ambient air temperature, water temperature, water salinity and local snow fall. People planning on an ice operation such as an ice road, air stop, or a site for an ice-supported drilling rig normally are dependent on the historical average ice thickness to base a decision on whether the ice will be thick enough to support their operation. In some ice covered areas the ice is historically too thin to allow certain types of ice-supported operations. In other areas the ice growth season is such that the ice-supported operation cannot be conducted in the short time span when the ice is at a suitable thickness. Under these conditions various means have been used to increase the ice thickness.

A common approach has been to keep the ice surface free of snow in areas where thick ice is desired. Snow normally acts as a thermal insulator and slows down the ice growth rate. Ice in snow free areas will grow faster and thicker than ice under snow.

Another approach to increasing ice thickness is to flood water on top of the ice and allow it to freeze. This operation is then repeated until the ice has reached a desired thickness. An alternate approach to flooding is to use a spray or sprinkler system to place water on the ice, which results in the ice freezing in thinner layers. The disadvantages to freezing water layers are (1) in using sea water, the brine content of the new ice is high, and thus the new ice is weaker than the orginal ice; and (2) in using sea or fresh water, air bubbles trapped in the ice weakens it. For large loads the required ice thickness is such that spraying and/or flooding methods become impractical because of the time involved in creating the desired ice thickness which in turn reduces the time available for conducting the primary operation.

Another approach has been to place fiberglas matting on top of the ice surface. The surface is then flooded or sprayed with water and allowed to freeze over the matting. This approach misses completely the correct technique to increase the load supporting capacity of the ice matrix because it ignores a very fundamental mechanism of ice failure.

SUMMARY OF THE INVENTION

In accordance with a preferred embodiment, a structure and method are disclosed for increasing the load bearing capacity of an ice sheet. A plurality of structural members are embedded in the ice sheet in its tensile stressed lower half to reinforce its tension bearing strength. Also, in the preferred embodiment the ends of the structural members are anchored to the top of the ice sheet around the periphery of the load bearing area of the ice sheet. Also, in the preferred embodiment, the structural members may have baffles secured along their length to assist in anchoring them within the ice sheet.

DETAILED DESCRIPTION OF A PREFERRED EMBODIMENT

Figure 1:
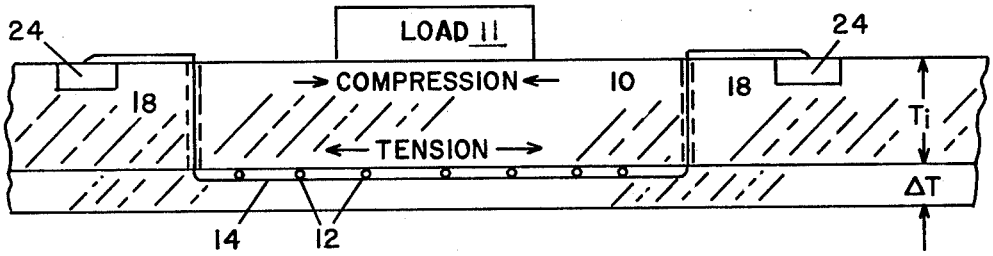
FIG. 1 is a cross-sectional, side view of an ice sheet reinforced in accordance with the teachings of the present invention.

Referring to FIG. 1, there is illustrated an ice sheet 10 having an initial thickness $T_i$, and having a load 11 placed thereon. The load causes the ice sheet to bend downward. Considering the ice sheet as divided into upper and lower halves, the bending causes compressional stresses in the upper half and tensile stresses in the lower half. Initial failure in the ice occurs in the lower half when the tensile stress exceeds the tensile strength of the ice which is generally fairly low in value. For a method to be effective in increasing the load supporting capacity of an ice sheet, it should reduce or eliminate the tensile stress generated in the ice.

Figure 2:
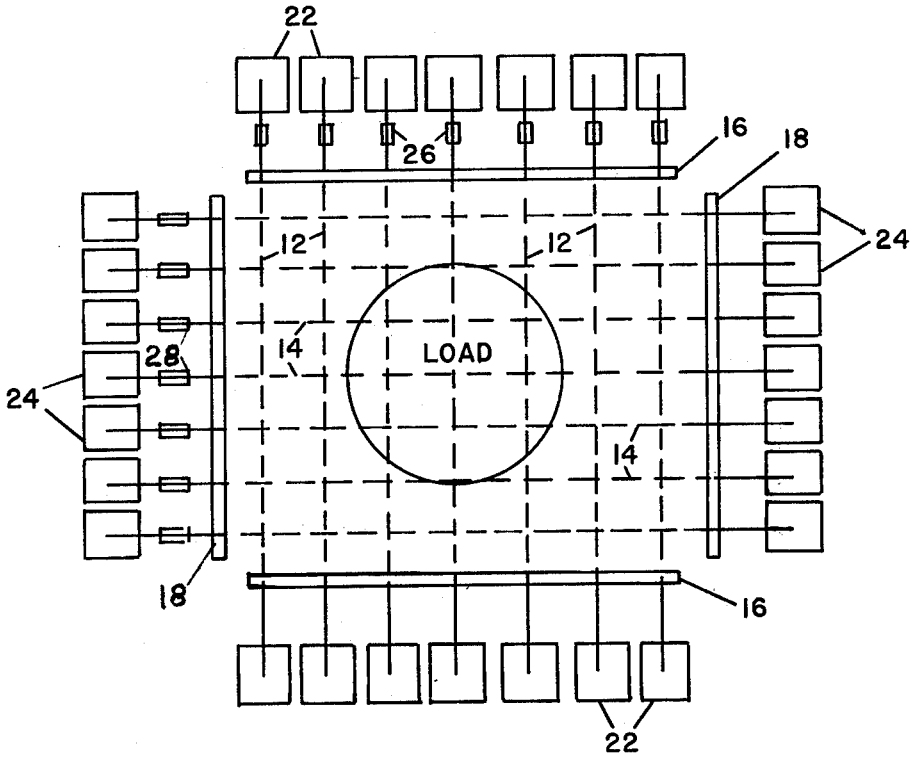
FIG. 2 is a top view of the arrangement of FIG. 1.

Referring to FIGS. 1 and 2, in one embodiment of the present invention the ice sheet is reinforced in tension by placing a plurality of cables 12 under the ice sheet in a first direction and a plurality of cables 14 under the ice sheet in a second direction. The cables 12 may be placed under the ice sheet by cutting trenches 16 in the ice sheet, and then passing each cable individually under the ice sheet from trench to trench. Likewise trenches 18 are cut for the cables 14, and then the cables 14 are passed individually under the ice sheet from trench to trench. Alternatively, instead of trenches, individual holes may be drilled for each cable. A commercially available tool that walks on the bottom of the ice sheet may be utilized to carry guide lines under the ice from trench to trench. The guide lines may then be used to pull cables from trench to trench. Once the cables are laid under the ice, a plurality of ice anchors 22 are secured to the ice and attached to each end of each of the cables. Likewise a plurality of ice anchors 24 are secured to the ice and attached to each end of the cables 14. Each cable 12 may include a tensioning device 26, which after anchoring, would be utilized to draw the cable taut. Likewise, each cable 14 may include a similar tensioning device 28 to draw it taut after anchoring. The ice is then allowed to freeze further such that an additional layer of ice $\Delta T$ forms underneath the cables, which secures the cables directly within the ice sheet. As illustrated in FIG. 1, the cables 12 and 14 are embedded in the tensile stressed, lower half of the ice sheet. For maximum effectiveness they should be positioned near the bottom of the lower half, and preferably below the middle of the lower half.

Figure 3:
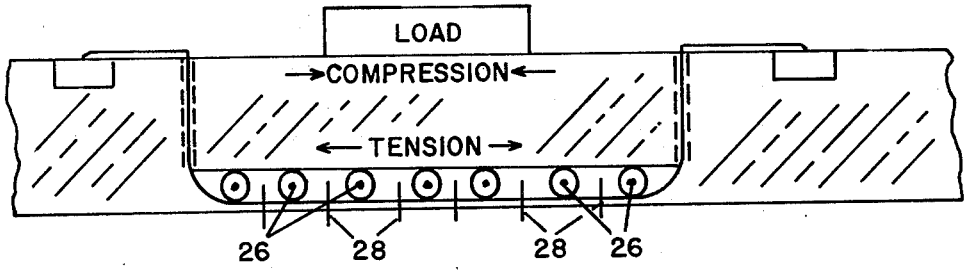
FIG. 3 is a cross-sectional, side view, similar to FIG. 1, but showing an alternative embodiment of the present invention.

FIG. 3 illustrates a second embodiment of the invention. In that embodiment the invention would be practiced as described with respect to FIGS. 1 and 2, but each cable 12 and 14 would have respectively a plurality of baffles 30 and 32 along its length which would serve to additionally anchor the cables to the ice after the second layer of ice $\Delta T$ had frozen.

Although the illustrated embodiment shows a rectangular matrix, other shape matrices such as a radial matrix, having each of the reinforcing members running radially, might be utilized. Also, other types of reinforcing materials besides cables may be utilized. A wire net may be positioned beneath the ice, or alternatively wire fencing material or reinforcing rods may be utilized.

There are alternative methods of constructing an ice matrix in accordance with the teachings of this invention. For instance, on very thin ice, the cable matrix may be laid on top, and then the surface flooded. The flooding must be sufficient such that in the resulting ice matrix, the cables reinforce the structure in tension, rather than in compression. Also, if the ice sheet is already substantially formed, trenches may be cut almost to the bottom of the ice sheet. Cables may then be laid in the bottom of each trench, and holes punched through the bottom to flood the trenches. When the water in the trenches freezes, the cables will be frozen into their proper positions to form an ice matrix in accordance with the teachings of the present invention.

Although at least one embodiment of the present invention has been described, the teachings of this invention will suggest many other embodiments to those skilled in the art.

The invention claimed is:

1. An ice matrix designed to increase the load bearing capacity of an ice sheet and comprising:

a. an ice sheet which, upon having a load placed on its surface, forms compressive stresses in its upper half and tensile stresses in its lower half; and b. a plurality of structural members having substantially all of their lengths which extend in a substantially horizontal direction embedded in the tensile stressed lower half portion of the ice sheet in a substantially horizontal direction to reinforce the ice sheet in tension, thereby increasing the load bearing capacity of the ice sheet.

2. An ice matrix as specified by claim 1 wherein the structural members are in the lower half of the tensile stressed half.

3. An ice matrix as set forth in claim 2 wherein said structural members are cables.

4. An ice matrix as set forth in claim 3 wherein said plurality of structural members form a rectangular matrix.

5. An ice matrix as set forth in claim 4 wherein said cables have baffle members positioned along their length to assist in anchoring the cables within the ice sheet.

6. An ice matrix as set forth in claim 5 wherein said cables are attached to ice anchors at their ends, and the ice anchors are embedded in the surface of the ice sheet around the area designed to be loaded.

7. A method of increasing the load bearing capacity of an ice sheet and comprising the following steps:

a. placing a plurality of structural members under an existing ice sheet to reinforce the tensile bearing strength of the bottom of the ice sheet; and b. allowing an additional layer of ice to form under the structural members such that the structural members are embedded in the ice sheet near its bottom to reinforce the tensile bearing strength of the ice sheet.

8. A method as set forth in claim 7 and including the step of anchoring each end of the structural bearing members to the surface of the ice sheet around the periphery of the load bearing area of the ice sheet, whereby each structural member is anchored to the surface of the ice sheet on one side of the load bearing area, and then passes under the ice sheet at its load bearing area to the other side of the load bearing area where it is brought to the surface of the ice sheet and the other end is anchored securely therein.

9. A method as set forth in claim 8 wherein the step of placing a plurality of structural members includes the step of placing a plurality of cables under the ice sheet.

10. A method as set forth in claim 9 and including the step of placing a plurality of baffles along the length of each structural member so that the baffles assist in anchoring the structural member securely within the ice sheet.

11. A method of increasing the load bearing capacity of an ice sheet and comprising the following steps:

a. cutting trenches in the ice sheet into its tensile stressed half and almost to the bottom of the ice sheet;

b. placing structural reinforcing members in the cut trenches;

c. allowing the trenches to fill with water and refreeze, whereby the structural members will reinforce the ice sheet in tension in its tensile stressed half.

12. A method as set forth in claim 11 wherein the step of cutting trenches includes the step of cutting trenches to form a matrix of cut trenches.

* * * * *